United States Patent [19]

Koch

[11] Patent Number: 4,527,520

[45] Date of Patent: Jul. 9, 1985

[54] LUBRICATION OF AN ANCILLARY PUMP FITTED TO AN ENGINE

[75] Inventor: John W. Koch, Como, Australia

[73] Assignee: Orbital Engine Company Proprietary Limited, Balcatta, Australia

[21] Appl. No.: 570,834

[22] Filed: Jan. 16, 1984

[30] Foreign Application Priority Data

Jan. 19, 1983 [AU] Australia ..... PF7675

[51] Int. Cl.[3] ..... F01M 1/00

[52] U.S. Cl. ..... 123/196 R; 123/198 C; 184/6.5

[58] Field of Search ..... 123/196 R, 196 CP; 184/6.5

[56] References Cited

U.S. PATENT DOCUMENTS

| | | | |
|---|---|---|---|
| 1,405,009 | 1/1922 | Rupright | 123/196 CP |
| 1,825,318 | 9/1931 | Kapp | 184/26 |
| 2,512,125 | 6/1950 | Whited . | |
| 2,513,547 | 7/1950 | Buell et al. | 123/196 CP |
| 2,728,412 | 12/1955 | Bolsius et al. | 184/6 |
| 2,781,632 | 2/1957 | Meijer | 123/196 CP |
| 3,512,610 | 5/1970 | Hollingworth | 184/6 |
| 3,526,298 | 9/1970 | Sann | 184/6 |
| 4,142,487 | 3/1979 | Somraty | 123/196 CP |

FOREIGN PATENT DOCUMENTS

| | | |
|---|---|---|
| 470828 | 11/1974 | Australia . |
| 57-52628 | 3/1982 | Japan . |
| 510255 | 7/1939 | United Kingdom . |
| 1298743 | 12/1972 | United Kingdom . |

*Primary Examiner*—E. Rollins Cross

*Attorney, Agent, or Firm*—Murray, Whisenhunt and Ferguson

[57] ABSTRACT

In combination with an internal combustion engine having a crankcase in which an air/oil mist mixture exists during normal operation of the engine, a pump having a crankshaft journalled in a crankcase, a cylinder, a piston coupled to said crankshaft to reciprocate in the cylinder, an intake and a return passage each communicating the pump crankcase with said engine compartment, and one-way valves in each of said passages arranged so that reciprocation of the pump piston will circulate the air/oil mist mixture from the engine compartment through the pump crankcase to provide lubrication to the compressor crankshaft and piston.

9 Claims, 3 Drawing Figures

LUBRICATION OF AN ANCILLARY PUMP FITTED TO AN ENGINE

This invention is directed to lubrication of a pump which is an ancillary to an internal combustion engine having a lubrication system.

When it is desired to run in close proximity an internal combustion engine, and a pump or like mechanical device which may be driven by the engine, the provision of an independent lubricant supply for the pump or like device can be difficult, complex or expensive.

Australian Pat. No. 523,968 describes a method of fuel metering for internal combustion engines which utilizes compressed gas as a means of propelling a metered volume of fuel. The compressed gas source is most conveniently a relatively small compressor operating in conjunction with the engine, and this operation is described in copending Australian Patent Application No. 92,002/82.

The provision of lubrication to such a compressor has some difficulties in automotive applications where it is impractical to provide for the compressor an independent lubrication system due to consideration of cost and complexity. Although the proximity of the internal combustion engine with its substantial lubrication system would be an ideal source of lubricating oil, it will be appreciated that the lubrication requirements of such a compressor are very small in comparison to that of the engine. It has been found that attempts to provide a sufficiently small, but necessarily regular flow of oil to the compressor results in blockage of the small orifices required to control the oil flows to the compressor. It will be appreciated that it is essential to ensure continuity of lubrication to the compressor and any such blockage or restriction will result in damage to the compressor.

It has been proposed in U.S. Pat. No. 1,825,318 and Japanese Pat. No. 57-52628 to lubricate ancillary equipment, such as an air compressor or a turbocharger, directly from the pressurised main oil system of an internal combustion engine. These proposals have no restrictor between the ancillary equipment and the main oil system and accordingly any breakdown or excessive wear in the ancillary equipment may result in reduction pressure in the engine main oil system. This loss of pressure may lead to major damage to the engine, as well as the ancillary equipment. In view of the relatively low cost of repair or replacement of the ancillary equipment compared with that of the engine, it is preferred to maintain the engine oil system independent of that of any ancillary equipment.

Australian Pat. No. 106,024 discloses a construction wherein the shaft of an impeller type water pump is lubricated by oil and/or oily vapor from the crankcase of an internal combustion engine. In this proposal a passageway is provided in the bearing member supporting the pump shaft, and a felt sleeve surrounds the bearing member. Oil is thrown onto the felt sleeve by an adjacent gear, and the oil soaks through the felt to enter the passage and hence pass to the shaft.

As the water pump is an impeller type, the shaft is only subject to pure rotary movement, and the shaft bearing is the only component requiring lubrication. In these simple operating conditions, the collection of oil on the absorbent felt sleeve, and the gravity flow of oil from the sleeve through the passage to the bearing is adequate. However, this form of lubrication system would be inadequate for more complete equipment, such as a piston pump, where a number of bearing surface, subjected to different motions, must each be effectively lubricated.

It is the object of the present invention to provide means for lubricating a piston type pump operating as an ancillary to an internal combustion engine. The lubrication means being inexpensive to construct, reliable in operation, and not directly operated from the pressurized oil system of the engine.

With this object in view, there is provided according to the present invention in combination with an internal combustion engine having a compartment in which an air/oil mist mixture exists during normal operation of the engine, a pump having a crankshaft journalled in a crankcase, a cylinder, a piston coupled to said crankshaft to reciprocate in the cylinder, an intake and a return passage each communicating the pump crankcase with said engine compartment, respective valves in said passages arranged so that reciprocation of the pump piston will circulate the air/oil mist mixture from the engine compartment through the pump crankcase to provide lubrication to the compressor crankshaft and piston.

Conveniently each of the valves is a one-way valve, preferably a reed valve. The inlet and return passages preferably communicate with the crankcase of the engine, but may communicate with other areas where an air/oil mist mixture exists, such as the timing gear chest or the engine valve mechanism compartment.

The variations in pressure created in the pump crankcase by the reciprocation of the piston, will create a pumping action whereby air and oil mist from the engine will be circulated through the pump crankcase and then returned to the engine. Thus a positive lubrication system is available for the pump that is derived from the engine without direct connection to the pressurised oil system of the engine.

The invention will be more readily understood from the following description with reference to the accompanying drawings of one practical arrangement of an air compressor and engine combination incorporating the present invention. In the drawings.

Figure 2:
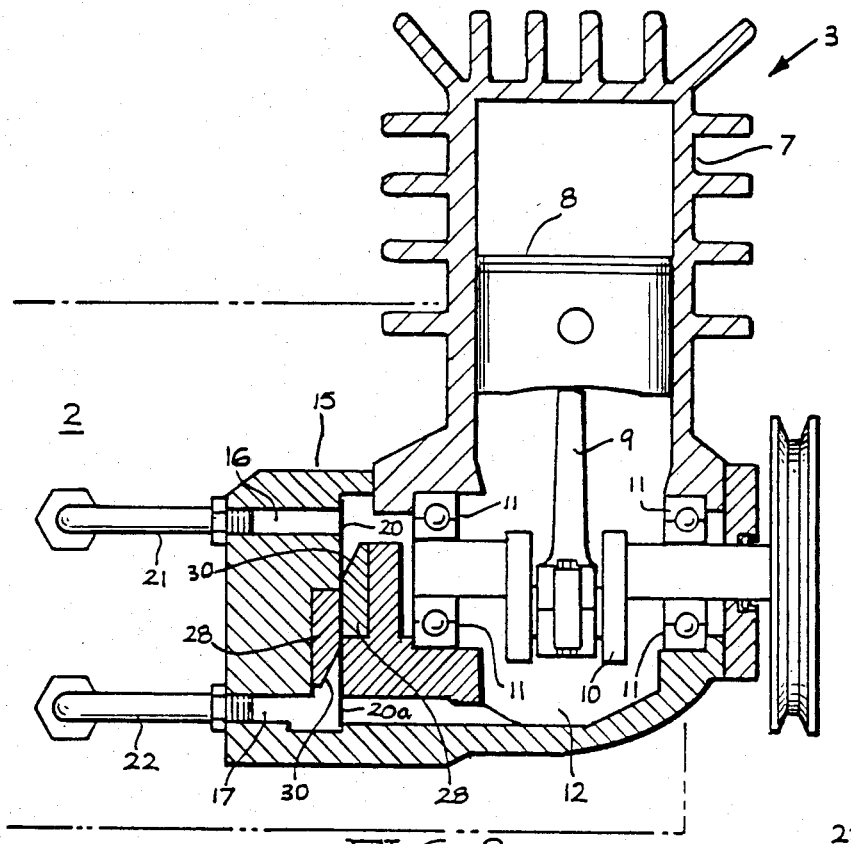
FIG. 2 is a sectional view of the compressor and a part of the engine as shown in FIG. 1.
Figure 1:
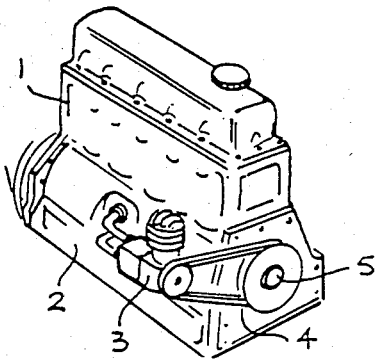
FIG. 1 is a perspective view of a conventional internal combustion engine with an air compressor fitted thereto.

Referring now to the drawings, engine 1 has a crankcase 2 which is a reservoir for the oil that lubricates the engine. The air compressor 3 is a reciprocating piston type which is driven by the belt 4 from the crankshaft 5 of the engine. The compressor 3 may however be independently driven such as by an electric motor.

The compressor 3 has a cylinder 7 and a piston 8 coupled by the connecting rod 9 to the crankshaft 10. The crankshaft 10 is supported in bearing 11 in the compressor crankcase 12.

The end plate 15 of the compressor has an inlet passage 16 and a return passage 17 formed therein. The inlet passage is in general alignment with the ball bearing 11 supporting one end of the compressor crankshaft 10, and the return passage communicates with the lower part of the crankcase 12. Respective reed valves 20 and **20*a* are located in the inlet and return passages. The pipes 21 and 22 communicate the inlet passage 16 and return passage 17 respectively with the interior of the engine crankcase 2**. The pipes are preferably of a flexible type to accommodate vibration and minor movements between the engine and compressor during operation.

The valve 20 in the inlet passage 16 opens and the valve 20*a* in the return passage 17 closes when the pressure in the engine crankcase 2 is higher than that in the compressor crankcase 12. In this situation air and oil mist will flow from the engine crankcase 2 into the compressor crankcase 12. Conversely when the pressure in the compressor crankcase 12 is higher than that in the engine crankcase 2, the inlet passage valve 20 will close and a return passage valve 20*a* will open, and so air and oil mist will flow from the compressor to the engine.

The pressure variation in the compressor crankcase 12 arising from the movement of the compressor piston 8 in the cylinder 7. The pressure in the crankcase 2 of the engine is subject to less pressure and less pressure variation than the crankcase of the compressor due to a number of factors. Firstly the capacity of the engine crankcase 2 is large relative to the displacement of the engine pistons, and secondly the engine crankcase is vented to reduce pressure built up. Further in a multi-cylinder engine as one piston is moving down another is moving up, and so has a balancing effect that reduces pressure variations in the engine crankcase.

In order to assist in attaining the required pressure variation in the compressor crankcase 12, venting of that compressor crankcase to atmosphere should be substantially eliminated.

Figure 3:
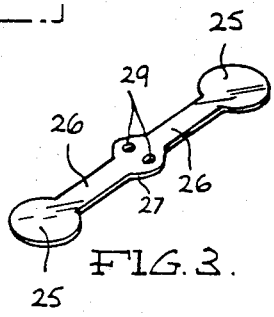
FIG. 3 is a perspective view of the reed valves of the compressor.

In the embodiment illustrated, the two reed valves 20 and 20*a* are a one piece member as shown in FIG. 3. The respective valve head portions 25 are located at the ends of respective arm portions 26 that extend from a central mounting portion 27. The mounting portion 27 is clamped between the guide plates 28 with dowel pins (now shown) extending into the apertures 29 in the mounting portion 27. The guide plates 28 have inclined faces 30 which engage the arms portions 26 when the valves are open and so limited the extent of opening of the valves.

I claim:

1. In combination with an internal combustion engine having a compartment in which an air/oil mist mixture exists during normal operation of the engine, a pump having a crankshaft journalled in a crankcase, a cylinder, a piston coupled to said crankshaft to reciprocate in the cylinder, means connecting the pump crankshaft to the engine for driving the pump by the engine, an intake and a return passage each communicating the pump crankcase with said engine compartment, respective valves in said passages arranged so that reciprocation of the pump piston will circulate the air/oil mist mixture from the engine compartment through the pump crankcase to provide lubrication to the pump crankshaft and piston.

2. The combination as claimed in claim 1, wherein each said valve is a one-way valve.

3. The combination as claimed in claim 1, wherein each said valve is a reed valve.

4. The combination as claimed in claim 1, wherein the compartment of the engine is an engine crankcase.

5. The combination as claimed in claim 2, wherein the compartment of the engine is an engine crankcase.

6. The combination as claimed in claim 3, wherein the compartment of the engine is an engine crankcase.

7. The combination of an internal combustion engine having an engine crankcase in which an air/oil mist exists during normal operation of the engine and an engine crankshaft journalled in the engine crankcase, and a pump having a pump crankcase, a pump crankshaft journalled in the pump crankcase, a cylinder, a pump piston coupled to the pump crankshaft to reciprocate in the cylinder, drive means for driving the pump crankshaft by the engine crankshaft, a mist intake passage and a mist return passage each communicating the engine crankcase with the pump crankcase, and one-way valve means located in said passages for circulating the air/oil mist from the engine crankcase through the mist intake passage to the pump crankcase and through the mist return passage back to the engine crankcase for providing lubrication to the pump crankshaft and pump piston upon reciprocation of the pump piston.

8. The combination as claimed in claim 7, wherein said one-way valve means are reed valves.

9. A method of lubricating a pump associated with an internal combustion engine having an engine crankcase in which an air/oil mist exists during normal engine operation, and an engine crankshaft journalled in the engine crankcase, said pump including a pump crankcase, a pump crankshaft journalled in the pump crankcase, a cylinder, a pump piston coupled to the pump crankshaft to reciprocate in the cylinder and drive means for driving the pump crankshaft by the engine crankshaft, said method comprising circulating the air/oil mist from the engine crankcase through an inlet passage and associated inlet one-way valve to the pump crankcase to lubricate the pump crankshaft and pump piston by variations in pressure created in the pump crankcase by reciprocation of the pump piston and returning the air/oil mist from the pump crankcase through a return passage and associated return one-way valve to the engine crankcase.

* * * * *